US006570272B2

(12) United States Patent
Dickhoff

(10) Patent No.: US 6,570,272 B2
(45) Date of Patent: May 27, 2003

(54) SAFETY SWITCHING DEVICE FOR CONNECTION AND SAFE DISCONNECTION OF AN ELECTRICAL LOAD, IN PARTICULAR AN ELECTRICALLY DRIVEN MACHINE

(75) Inventor: Rolf Dickhoff, Kirchheim (DE)

(73) Assignee: Pilz GmbH & Co., Ostfildern (DE)

( * ) Notice: Subject to any disclaimer, the term of this patent is extended or adjusted under 35 U.S.C. 154(b) by 0 days.

(21) Appl. No.: 10/143,480

(22) Filed: May 9, 2002

(65) Prior Publication Data

US 2002/0130557 A1 Sep. 19, 2002

Related U.S. Application Data

(63) Continuation of application No. PCT/EP00/10788, filed on Nov. 2, 2000.

(30) Foreign Application Priority Data

Nov. 12, 1999 (DE) ..... 199 54 460

(51) Int. Cl.[7] ..... H01H 19/64
(52) U.S. Cl. ..... 307/113; 307/125; 307/141.8
(58) Field of Search ..... 307/113, 116, 307/125, 131, 139, 141.8

(56) References Cited

U.S. PATENT DOCUMENTS 4,767,941 A * 8/1988 Brand et al. ..... 307/113
4,992,904 A * 2/1991 Spencer et al. ..... 361/13
5,412,528 A * 5/1995 Mader et al. ..... 361/115
5,825,102 A * 10/1998 Babiel et al. ..... 307/113
6,297,569 B1 * 10/2001 Bartels et al. ..... 307/113
6,359,763 B1 * 3/2002 Edwards ..... 361/18

FOREIGN PATENT DOCUMENTS

| | | |
|---|---|---|
| DE | 29 20 188 B1 | 3/1980 |
| DE | 34 32 476 A1 | 3/1986 |
| DE | 41 07 668 C2 | 11/1994 |
| DE | 197 36 183 C1 | 2/1999 |

* cited by examiner

*Primary Examiner*—Brian Sircus
*Assistant Examiner*—Sharon A. Polk
(74) *Attorney, Agent, or Firm*—Harness, Dickey & Pierce, P.L.C.

(57) ABSTRACT

The present invention relates to a safety switching device for connecting and safely disconnecting an electrical load, in particular an electrically driven machine. The safety switching device includes first and second electromechanical switching elements whose operating contacts are arranged in series with one another between a first input terminal and an output terminal of the switching device. Furthermore, the switching device has a second input terminal for receiving a switching signal. The switching signal acts on the switch position of the operating contacts of the two switching elements. According to a preferred embodiment, the first switching element has a lower nominal switching capacity than the second switching element.

10 Claims, 2 Drawing Sheets

SAFETY SWITCHING DEVICE FOR CONNECTION AND SAFE DISCONNECTION OF AN ELECTRICAL LOAD, IN PARTICULAR AN ELECTRICALLY DRIVEN MACHINE

CROSS REFERENCES TO RELATED APPLICATIONS

This application is a continuation of copending international patent application PCT/EP00/10788 filed on Nov. 2, 2000 and designating the U.S., which claims priority from German patent application DE 199 54 460.3 filed on Nov. 12, 1999.

BACKGROUND OF THE INVENTION

The present invention relates to a safety switching device for connection and safe disconnection of an electrical load, in particular an electrically driven machine, having a first and a second electromechanical switching element, whose operating contacts are arranged in series with one another between a first input terminal and an output terminal of the switching device, and having a second input terminal for a switching signal, which acts on the switch position of the operating contacts of the two switching elements.

Safety switching devices of this generic type are primarily used in the industrial field, in order safely disconnect (switch off, shut down) electrically driven machines, such as a press brake or a milling tool. They are particularly used in conjunction with a mechanically operable emergency off button, in order to disconnect the machine quickly and safely in an emergency situation. To this end, the power supply to the machine to be disconnected is routed via the operating contacts of the two electromechanical switching elements which have been mentioned. The power supply to the machine is interrupted as soon as even only one of the two switching elements opens its operating contacts.

One known problem with the switching elements that are used is that the opening and closing of a operating contact when voltage is applied to it can result in sparks being formed. Depending on the magnitude of the current which is being carried via the contact, the spark formation is pronounced to a lesser or greater extent. With very heavy currents, an arc is formed between the operating contacts and, as a result of its high temperature, it can lead to the operating contacts being welded to one another. This can lead to the operating contacts remaining firmly stuck to one another, so that it is no longer possible to open the switching element. As the strength of the current to be switched increases, measures are therefore required for arc quenching. The complexity of such measures increases as the strength of the current that is to be switched increases, so that switching elements for heavy and very heavy currents are correspondingly expensive.

In safety switching devices of the type mentioned initially, at least two switching elements are used in series, in order to ensure safe disconnection of the power supply even if the operating contacts of one switching element remain stuck to one another as a result of having been welded. In the case of the safety switching device disclosed in DE 197 36 183 C1, by way of example, two safety relays in series are used as switching elements.

Until now, two switching elements have always been used in this case which have the same nominal switching capacity with respect to the same load class. The nominal switching capacity here indicates the maximum current that a switching element can switch at a specific voltage and with a specific power factor cos Φ, without being damaged. The load class defines the characteristics of the load to be switched, e.g. whether it is a purely resistive load (load class AC 1) or a somewhat inductive load (load class AC 3). Spark formation is particularly severely pronounced in the latter case.

The use of two switching elements with the same nominal switching capacity has the disadvantage that both switching elements are subject to the same relative loads with regard to their respective capacities. This means that both switching elements are subject to the same relative wear, and this also conceals the risk of the possibility of both switching elements failing at the same time, for example by the operating contacts welding in both switching elements in the same switching process.

Furthermore, use of two switching elements with the same nominal switching capacity results in the costs always rising by a factor of 2 when switching elements with a relatively high nominal switching capacity are required for switching relatively heavy currents.

SUMMARY OF THE INVENTION

It is an object of the present invention to specify an alternative safety switching device which offers particularly high safety with regard to the possible welding of operating contacts when carrying heavy currents, and which is cost-effective at the same time.

According to a preferred embodiment of the invention, this object is achieved in that, with the safety switching device mentioned initially, the first switching element has a lower nominal switching capacity than the second switching element.

The new safety switching device differs from the previously known safety switching devices in that the two switching elements which are arranged in series with one another have different nominal switching capacities. This applies at least with reference to the same load class. This feature has the advantage that the switching elements used are subjected to relative loads of different severity with respect to their nominal switching capacities. This means that the wear on the two switching elements is different. Furthermore, this reduces the probability of both switching elements being subject to fail at the same time. This results in a particularly high safety margin against unobserved and dangerous welding of the operating contacts.

Furthermore, the measure has the advantage that the costs of a switching device for relatively heavy currents no longer rise more than proportionately. In consequence, it is possible to design a safety switching device of the type mentioned initially such that it is capable of switching heavy and very heavy currents already on its own.

The stated object is thus completely achieved.

In one refinement of the invention, the safety switching device has a timer unit which processes (delays) the switching signal such that, while connecting the load, it acts earlier on the operating contacts of the first switching element, and, while disconnecting the load, it acts later on the operating contacts of the first switching element than on the operating contacts of the second switching element.

This feature has the advantage that the first switching element is not switched on load during normal operation. In consequence, no sparks or arcs can be formed between its operating contacts, so that the wear on the first switching element is reduced considerably, and welding is also precluded. The first switching element thus has a long life despite its relatively low nominal switching capacity while, at the same time, the safety switching device can be designed overall for switching heavy currents. If the second switching element, which is always switched on load, were to fail as a result of the operating contacts being welded, it is sufficient that the previously "protected" first switching element can carry out one successful switching process on load, in which its operating contacts are opened.

In this refinement of the invention, as well, the two switching elements thus have different "life expectancies", with the "daily load" in this case being applied to the stronger, second switching element. However, simultaneous failure of the two switching elements is in consequence once again virtually precluded. Furthermore, this refinement has the advantage that the first switching element may even be designed to have a lower nominal switching capacity than in comparable switching devices, in some circumstances. This is because the first switching element essentially needs to be able to carry out only one successful switching process on load. If its operating contacts are damaged in this switching process, this is irrelevant, since the safety switching device must be replaced in any case, owing to the defect in the second switching element. The first, very low-cost switching element thus acts as a type of fuse in this case, which can be damaged when it operates. The safety switching device in this refinement is, however, actually highly cost-effective for switching heavy and very heavy currents, since it requires only one switching element having the necessary very high nominal switching capacity.

In a further refinement of the invention, at least the first and the second switching element are surrounded by a common, tightly closed enclosure, from which the first input terminal and the output terminal are passed out.

The tightly closed enclosure is a compact enclosure which surrounds the two switching elements such that the user has no access to them. This avoids damage in the safety-relevant operating circuit of the safety switching device. The reliability and safety of the switching device with regard to faults in the installation and with regard to manipulation are thus considerably improved. The advantage of said feature becomes particularly clear in comparison to the previously practiced solutions, in which contactors, which had to be installed individually, were used in addition to the known safety switching devices in order to switch very heavy currents. In contrast to this, the said feature provides a single, compact component, which is simple to install.

In a further refinement of the invention, the first and the second switching element are arranged on a common component mount.

This feature again has the advantage that the safety and reliability of the switching device are improved, since faulty wiring is actually prevented at the production stage. Furthermore, this feature also improves the compactness and capability to use the safety switching device in modular form.

In a further refinement of the invention, the first and the second switching element each have at least one auxiliary contact, which is positive-guided by the respective operating contact in a mechanical way.

Positive-guided means that the switch position of the auxiliary contacts is necessarily or inevitably coupled to the switch position of the operating contacts, so that the switch position of the auxiliary contacts always makes it possible to reliably determine the switch position of the operating contacts without having to access the operating circuit of the switching elements. By means of such a positive-guidance it is possible to obtain a reliable statement on the switch position of the operating contacts of the two switching elements. Due to the feature mentioned, safety of the switching device is further improved, since a safe disconnection of the power supply can easily be checked, just from the position of the auxiliary contacts.

In a further refinement of the invention, the first switching element is a relay.

As is usual in the conventional specialist technology, the term "relay" relates here to an electromechanical switching element that is capable of switching low to medium current levels. In particular, such a relay has only a single pair of contacts as operating contact. The measure provides the advantage that such relays are available at low cost as standard components, so that their use reduces the costs of the safety switching device overall. This applies in particular in combination with the already described refinement, in which the first switching element is used in the manner of a fuse.

In a further refinement of the invention, the second switching element is a contactor.

According to German Industry Standard DIN 57 660, Part 103, a contactor is, to be precise, a switching element with only one rest position, which is not operated by hand, and which can connect, convey and disconnect currents under normal circuit conditions including operation overloads. In practice, the primary difference between contactors and simple relays is that the current path in the main circuit passes via at least two mutually isolated pairs of operating contacts, so that a contactor intrinsically has redundancy with respect to the operating contacts. In contrast, a simple relay has only one pair of contacts in the main circuit. In addition, contactors have integrated measures for quenching sparks and arcs.

The measure has the advantage that, by virtue of its nature, a contactor is very robust even when switching operations occur frequently. Particularly when used in combination with the refinement of the invention mentioned initially, the life of the safety switching device is considerably increased accordingly. Furthermore, the measure has the advantage that the main circuit of the safety switching device is closed only when it is active, since a contactor naturally trips back to its open rest position when no switching signal is present. In consequence, the safety of the switching device is further improved when using a contactor.

In a further refinement of the invention, the safety switching device is configured as a contact enhancing unit for connection to a preceding switching device.

As an alternative to this feature, it is possible to design the safety switching device as an intrinsically fully functional unit. In contrast, said feature provides the advantage that the safety switching device is required, as a modular connection appliance, only where there is actually a need to switch heavy and very heavy currents. Furthermore, numerous switching devices which have been developed on a customer-specific basis for low and medium currents can be upgraded easily and cost-effectively in this way for switching heavy and very heavy currents. This refinement of the inventive safety switching device can thus be manufactured in considerably greater quantities, thus once again allowing the costs to be reduced overall.

It goes without saying that the features mentioned above as well as those which are still to be explained in the following text can be used not only in the respectively stated combination but also in other combinations or on their own, without departing from the scope of the present invention.

BRIEF DESCRIPTION OF THE DRAWINGS

Exemplary embodiments of the invention are illustrated in the drawing, and will be explained in more detail in the following description. In the drawing.

DETAILED DESCRIPTION OF PREFERRED EMBODIMENTS

Figure 1:
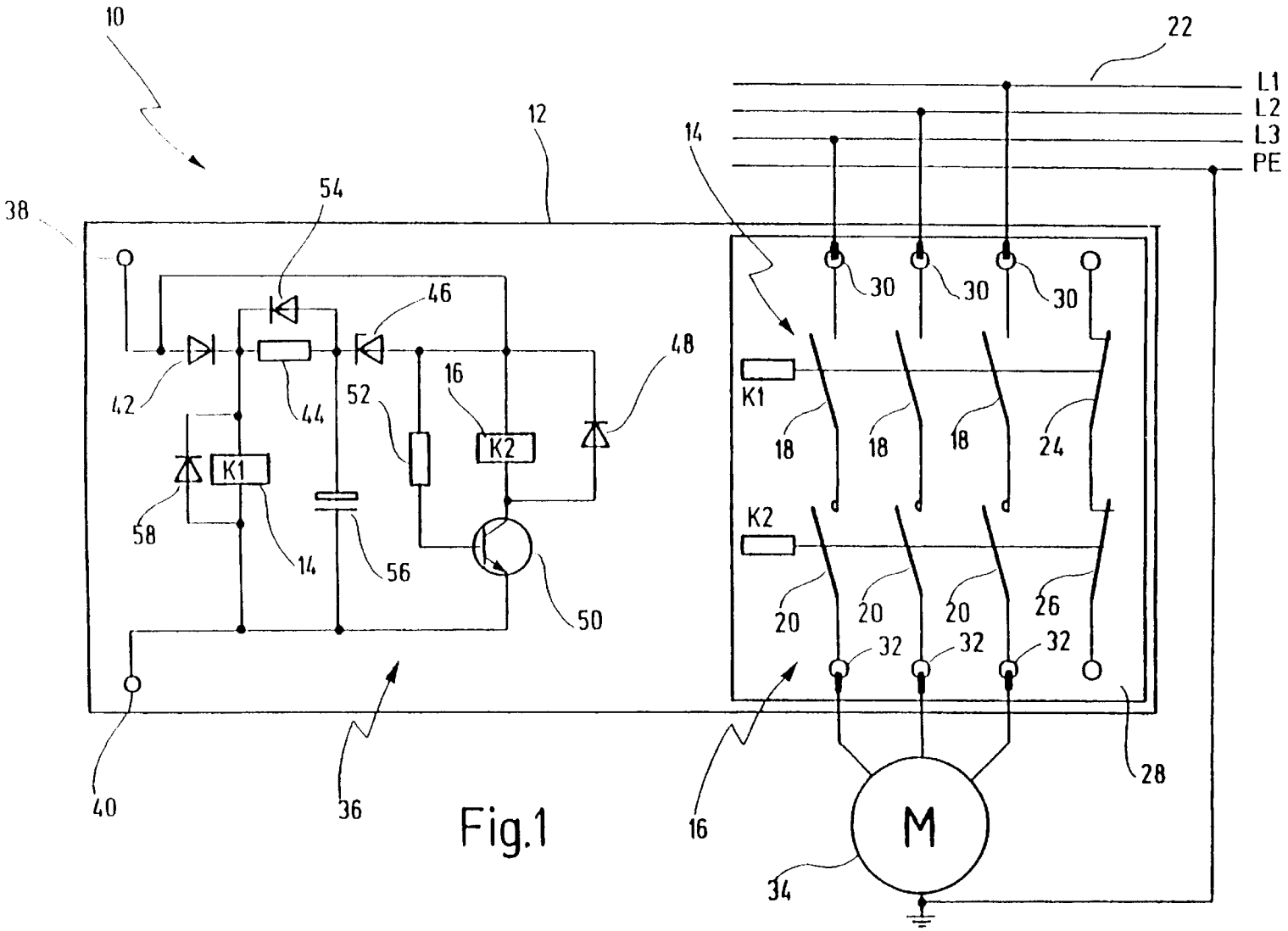
FIG. 1 shows a schematic illustration of a safety switching device according to one embodiment of the invention in the form of a safe contact enhancing unit.

In FIG. 1, a safety switching device which is configured as a safe contact enhancing unit, is designated by reference number 10.

The switching device 10 is installed in a compact, tightly closed enclosure 12, from which a number of input terminals and output terminals are passed out. In FIG. 1, only those components of the switching device 10 that are relevant with respect to the invention are schematically illustrated. Further components of switching devices of this type, which are known per se, such as readiness indications for instance, have been omitted for sake of clarity.

The switching device 10 has a first switching element 14 and a second switching element 16, whose respective operating contacts 18 and 20 are arranged in series with one another. In the present case, each of the two switching elements 14, 16 has three sets of operating contacts 18 and 20, respectively, which are positive-guided one to another. Each of the two switching elements 14, 16 is thus able to switch three phases of a power supply 22. Furthermore, each of the two switching elements 14, 16 has an auxiliary contact 24, 26, which is likewise positive-guide by the respective operating contacts 18 and 20. The auxiliary contacts 24, 26 of the two switching elements 14, 16 are likewise connected in series with one another. It is thus possible by means of a current which is passed via the auxiliary contacts 24, 26 (not illustrated) to check the switch position of the operating contacts 18, 20 of the switching elements 14, 16 without having to access the main circuit of the switching elements 14, 16 directly.

The two switching elements 14, 16 are rigidly arranged on a common component mount 28 within the enclosure 12. The first switching element 14 is a relay, whose operating contacts 18 each have only one pair of contacts. For load class AC 3, it has a nominal switching capacity of 8 A. The second switching element 16 is a contactor, whose nominal switching capacity for load class AC 3 is 16 A.

The operating contacts 18, 20 of the two switching elements 14, 16 each form a current path which connects first input terminals 30 of the switching device 10 to output terminals 32. During the installation of the switching device 10, the individual phases of the power supply 22 are connected to the input terminals 30. In contrast, the output terminals 32 are connected to the electrical load which is in turn to be connected and disconnected by means of the switching device 10. By way of example, a motor 34 is shown here as an electrical load.

The switching device 10 furthermore has an input circuit, which has a timer unit 36. Timer unit 36 is driven via a second input terminal 38 and an output terminal 40 with a switching signal, which acts on the switch position of the operating contacts 18, 20 in the manner explained in the following text. The timer unit 36 in this case delays the switching sequence of the operating contacts 18, 20 in the manner illustrated in FIG. 2.

Starting from the second input terminal 38, the timer unit 36 first has a diode 42 arranged in the forward direction, and whose cathode is connected to a series circuit formed from a resistor 44 and a reverse-biased zener diode 46. The anode of zener diode 46 is connected to an input connection of a control circuit for the second switching element 16. A reverse-biased diode 48 is connected in parallel with the second switching element 16. The output connection of the control circuit of the second switching element 16 is connected to the collector of a transistor 50, whose emitter is connected to the output terminal 40. The base of transistor 50 is connected via a resistor 52 to the anode of the zener diode 46, and to the input terminal of the control circuit for the second switching element 16.

A diode 54, whose cathode is connected to the cathode of diode 42, is connected in parallel with resistor 44. The anode of diode 54 is connected to the cathode of zener diode 46. Furthermore, the anode of diode 54 is connected to the output terminal 40 via a capacitor 56.

On the cathode side, the diodes 42 and 54 are connected to the input terminal of the control circuit for the first switching element 14. On the output side, the control circuit for the first switching element 14 is connected to the output terminal 40. A reverse-biased diode 58 is connected in parallel with the first switching element 14. Finally, the input terminal 38 is also connected directly to the input side of the control circuit for the second switching element 16.

The switching device 10 of this exemplary embodiment is used as a contact enhancing unit, which can be connected via the second input terminal 38 and the output terminal 40 to a preceding switching device, which is not illustrated here. This exemplary embodiment has been chosen for sake of simplicity, since the circuitry of a contact enhancing unit is constructed in a comparatively simple and clear manner. However, the invention can equally well be used with a complete safety switching device, to which an emergency off button just needs to be connected for operation.

The method of operation of the timer unit 36, and hence of the switching device 10, will be explained in the following text.

When a positive voltage signal is present between the second input terminal 38 and the output terminal 40, diode 42 is forward-biased. In consequence, a current flows from the second input terminal 38 via diode 42 and through the control circuit for the first switching element 14 to the output terminal 40. In consequence, the first switching element 14 is activated, that is to say the operating contacts 18 are closed. At the same time, the positive guidance results in the auxiliary contact 24 being opened. Furthermore, the current also flows from the second input terminal 38 via resistor 44 to capacitor 56, which is charged in consequence. As soon as the voltage across capacitor 56 exceeds the breakdown voltage of the zener diode 46, this zener diode 46 carries current, and, in consequence, a base current flows via resistor 52 through transistor 50. In consequence, transistor 50 is in turn switched on, so that a current can now flow through the control circuit for the second switching element 16. As a consequence of this, the second switching element 16 is also activated, that is to say the operating contacts 20 are closed, and the auxiliary contact 26 is opened. In this state, the current paths between the first input terminals 30 and the output terminals 32 are closed, so that motor 34 is supplied with power.

For the following description, it is assumed that the timer unit 36 has been connected to voltage for a sufficiently long period to allow the capacitor 56 to be charged. If the voltage between the second input terminal 38 and the output terminal 40 is now removed, the second switching element 16 drops back to its passive state. In consequence, the operating contacts 20 are opened at the same time, and the auxiliary contact 26 is closed. As a consequence of this, the power supply to the motor 34 is interrupted abruptly.

Furthermore, owing to the charged capacitor 56, diode 54 is forward-biased, and capacitor 56 is discharged via the control circuit for the first switching element 14. This first switching element 14 is thus still held in its active state for a certain time, that is to say the operating contacts 18 still remain closed for a certain time period. As soon as the voltage across capacitor 56 falls below the tripping voltage of the first switching element 14, the operating contacts 18 also trip, so that the power supply to the motor 34 is interrupted at the latest at this time, even if one or more operating contacts 20 in the second switching element 16 were still to stick to one another. Furthermore, the current path via the two auxiliary contacts 24, 26 is now closed, thus allowing a reliable conclusion to be drawn that the motor 34 has been disconnected, on the basis of the positive guidance.

The diodes 48 and 58, which are arranged in parallel with the two switching elements 14, 16, are used in a manner known per se for supplementary spark quenching.

The timer unit 36 ensures that the operating contacts 18 of the first switching element 14 are always closed earlier, during connection of the power supply for the motor 34, than the operating contacts 20 of the second switching element 16. Conversely, the operating contacts 20 of the second switching element 16 are always opened earlier during disconnection of the motor 34, than the operating contacts 18 of the first switching element.

Figure 2:
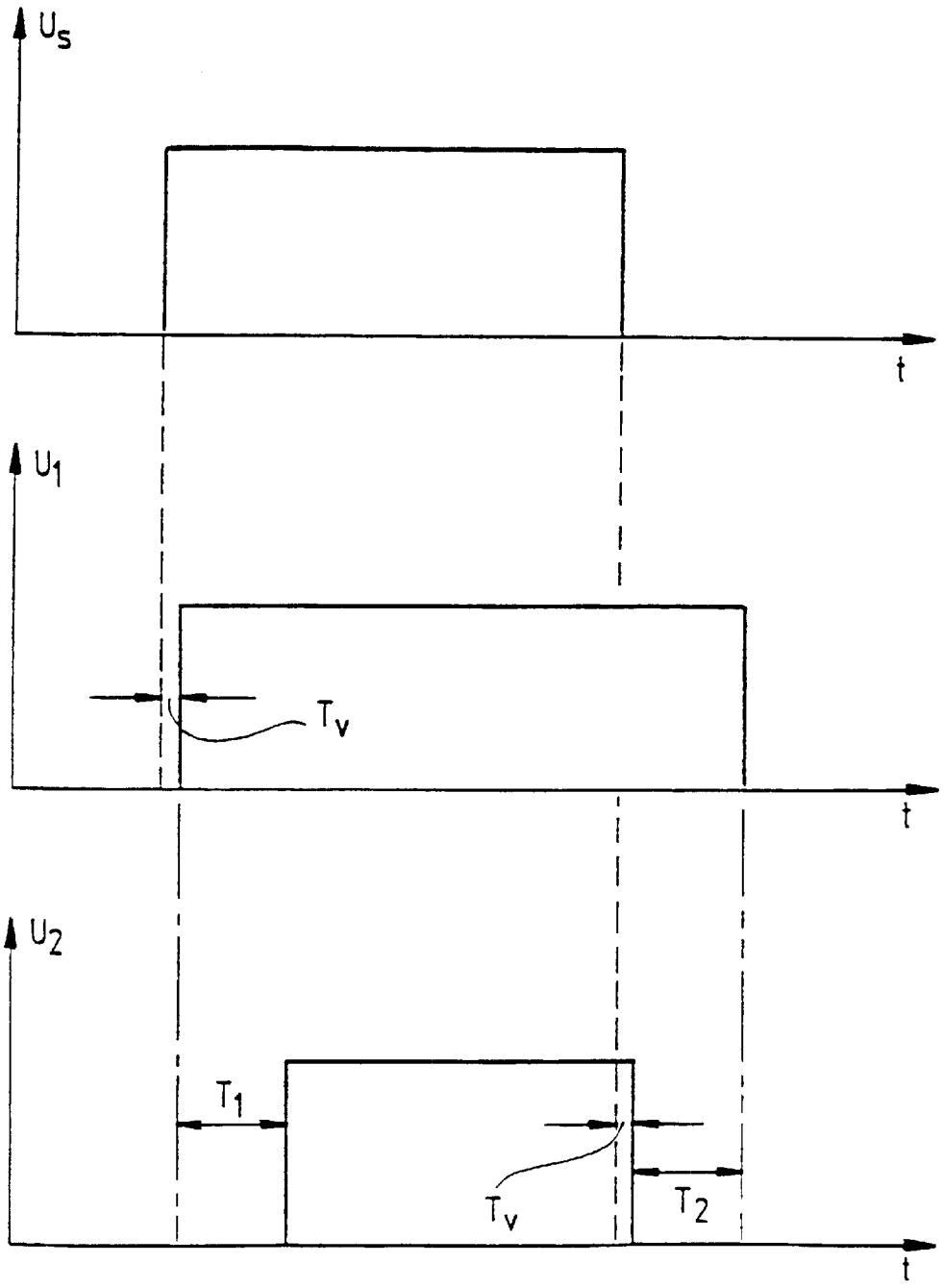
FIG. 2 shows the switching sequence, in time, for the first and the second switching element according to a preferred embodiment of the invention.

These timings are shown in FIG. 2 in the form of three timing diagrams in which $U_s$ denotes the switching signal between the second input terminal 38 and the output terminal 40. As can be seen from the illustration, the pull-in voltage $U_1$ for the operating contacts 18 of the first switching element 14 occurs at a time advanced by a time interval $T_1$ before the pull-in voltage $U_2$ for the operating contacts 20 of the second switching element 16. Conversely, the pull-in voltage $U_2$ for the second switching element 16 falls by a time interval $T_2$ earlier than the pull-in voltage $U_1$ for the first switching element 14. In addition to the two time intervals $T_1$ and $T_2$, FIG. 2 also shows delays $T_v$, which are dependent on the switching times, between the switching signal $U_s$ and the pull-in voltages $U_1$ and $U_2$.

It will be appreciated that the term "connection" for the purposes of the present invention denotes a voltage rise from a magnitude below the tripping voltage of the two switching elements 14, 16 to a magnitude above the pull-in voltage of the two switching elements 14, 16 within a time which is short in comparison to $T_1$. Conversely, the term "disconnection" denotes a drop in voltage from above the holding voltage of the switching elements 14, 16 to a value below the tripping voltage of the switching elements 14, 16 within a time period which is short in comparison with the time interval $T_2$. In fact, the switching signals shown in FIG. 2 do not have infinitely steep rising and falling flanks.

In a further exemplary embodiment of the invention, which is not illustrated here, the safety switching device 10 is a fully functional stand-alone appliance which, in addition to the components described already, has its own voltage supply. The switching device of this exemplary embodiment uses the voltage supply to produce a voltage signal, by means of which the switch position of a passive emergency off button can be checked. The operating contacts of the two switching elements 14, 16 are then driven via a circuit, which corresponds to the timer unit 36, as a function of a switching signal obtained from this.

What is claimed is:

1. A safety switching device for connecting and safely disconnecting an electrical load in response to an external switching signal, said switching device comprising:

a relay having at least a first operating contact, a first auxiliary contact, and a first nominal switching capacity, said first operating contact and said first auxiliary contact each having a first and a second switch position, and said contacts being linked to one another such that the switch position of said first auxiliary contact is necessarily coupled to the switch position of said first operating contact, thereby allowing to reliably determine the switch position of said first operating contact from the switch position of said first auxiliary contact, a contactor having at least a second operating contact, a second auxiliary contact, and a second nominal switching capacity which is higher than said first nominal switching capacity, said second operating contact and said second auxiliary contact each having a third and a fourth switch position, and said second operating contact and second auxiliary contact being linked to one another such that the switch position of said second auxiliary contact is necessarily coupled to the switch position of said second operating contact, thereby allowing to reliably determine the switch position of said second operating contact from the switch position of said second auxiliary contact, at least a first input terminal, a second input terminal, and an output terminal, wherein said first and second operating contacts are arranged in series with one another between said first input terminal and said output terminal, and wherein said second input terminal is adapted to receive said switching signal, and a timer unit connected to said second input terminal, said timer unit being adapted to process said switching signal such that, when connecting the load, the switching signal acts on the first operating contact earlier than on the second operating contact, and, when disconnecting the load, the switching signal acts on the first operating contact later than on the second operating contact.

2. The safety switching device of claim 1, further comprising a tightly closed enclosure which surrounds at least said relay and said contactor, said first input terminal and said output terminal being passed out from said enclosure.

3. The safety switching device of claim 1, further comprising a common component mount where said relay and said contactor are arranged on.

4. A safety switching device for connection and safe disconnection of an electrical load in response to an external switching signal applied to said switching device, said switching device comprising:

a first electromechanical switching element having at least a first operating contact with a first and a second switch position, a second electromechanical switching element having at least a second operating contact with a third and a fourth switch position, at least a first input terminal, a second input terminal, and an output terminal, wherein said first and second operating contacts are arranged in series with one another between said first input terminal and said output terminal, and wherein said second input terminal is adapted to receive said switching signal, and a timer unit connected to said second input terminal, said timer unit being adapted to delay said switching signal such that, when connecting the load, the switching signal acts on the first operating contact earlier than on the second operating contact, and, when disconnecting the load, the switching signal acts on the first operating contact later than on the second operating contact, wherein said first switching element has a lower nominal switching capacity than said second switching element.

5. The safety switching device of claim 4, further comprising a tightly closed enclosure which commonly surrounds at least said first and second switching elements, said first input terminal and said output terminal being passed out from said enclosure.

6. The safety switching device of claim 4, further comprising a common component mount where said first and second switching elements are arranged on.

7. The safety switching device of claim 4, wherein said first and second switching elements each have at least one auxiliary contact which is positive-guided by the respective operating contact in a mechanical way.

8. The safety switching device of claim 4, wherein said first switching element is a relay.

9. The safety switching device of claim 4, wherein said second switching element is a contactor.

10. The safety switching device of claim 4, wherein said safety switching device is configured as a contact enhancing unit for connection to an existing switching device.

* * * * *